US006117522A

United States Patent [19]

Po-Chin

[11] Patent Number: 6,117,522

[45] Date of Patent: Sep. 12, 2000

[54] NON OIL COATED CONSTRUCTION FORM

[75] Inventor: Chang Po-Chin, Kaohsiung, Taiwan

[73] Assignee: Guang Ching Cheng Enterprise Co., Ltd., Kaohsiung, Taiwan

[21] Appl. No.: 09/343,195

[22] Filed: Jun. 30, 1999

[51] Int. Cl.[7] ..... B32B 3/00

[52] U.S. Cl. ..... 428/119; 52/309.1

[58] Field of Search ..... 428/119; 52/309.1

*Primary Examiner*—Alexander S. Thomas
*Attorney, Agent, or Firm*—Dougherty & Troxell

[57] ABSTRACT

A non oil coated construction form is disclosed. It is composed of a pair of struts and a flat plate with its rear surface fixed successively with a plurality of nailed joints to the struts, the plate is made of braided hemp fiber impregnated in phenolic resin and hardened. After drying, cooling, cutting and thermocompressing to be formed into a laminated phenolic compound resin material with intensified mechanical strength and a flat smooth surface. The form of the present invention is stronger, more easily detachable, durable and cost saving compared to a conventional lumber form. In addition, owing to flatness and smoothness of its surface, the surface of the concrete body does not have to be buffed after removal of the form of the present invention.

1 Claim, 4 Drawing Sheets

NON OIL COATED CONSTRUCTION FORM

BACKGROUND OF THE INVENTION

1. Field of the Invention

The present invention relates to a non oil coated construction form, and more particularly, to a form which is made of braided hemp fiber impregnated in phenolic resin and hardened by a hardener, and after the steps of drying, cooling, cutting and thermocompressing to be formed into a laminated phenolic compound resin material with intensified mechanical strength and a smooth surface. The life time of the construction form made as such is more than five times that of a conventional water proof form, and furthermore, convenient to handle in working site.

2. Brief Description of the Prior Art

At present, most of constructional works are built of steel reinforced concrete. In the construction work, a plurality of lumber plates with struts are used to form a cavity of steel bars in a certain configuration wherein wet concrete is deposited. After the concrete has dried, the lumber form is detached and there appears a constructional body of concrete block. However, a form plays an important role in construction work.

FIG. 1A shows a typical conventional lumber form 1 which is composed of a plurality of lumber plates cut from a whole piece of lumber. A unit of lumber form includes a pair of upright struts 2, 3 with a plurality of transversely laid lumber plates 4, 5, 6 . . . therebetween and connected with nails. A cavity of construction body is surrounded by the form 1 which is composed of these successively laid plurality of transverse plates 4, 5, 6 . . . thereby ready for depositing wet concrete.

Incidentally, there are some shortcomings inherent to such conventional techniques, and are as follows:

1. The grains and streaks of wood on the unbuffed surface of the lumber plates 4, 5, 6 . . . may be printed on the surface of the concrete body requiring an additional step of removing them by polishing after detaching the form.
2. Moreover, a poor rugged surface of the concrete body will result by the burrs existing on the surface of the lumber plates 4, 5, 6 . . . , especially in the case when rapid drying cement is used. Both the form and the surface of the concrete body will be damaged.
3. The wet concrete may leak through the clearances 1A, 1B . . . formed between adjacent plates 4, 5, 6 . . . during concrete deposition which causes not only wasting the concrete and contaminating the work site, but also obtaining a concrete body with rugged ugly surface.
4. For the purpose of eliminating the above mentioned shortcomings, in the recent construction site of a chemical work located at the west sea coast of middle Taiwan, oil was applied to coat on the surfaces of the plates 4, 5, 6 . . . which were in contact with the concrete. But there happened an unexpected event that sand particles brought by sea winds stick to the surface of undried oilly surface of the concrete body whereby resulting in a concrete body with an ugly scarred surface since it took time to wait for oil to dry up.

FIG. 1B shows another type of a conventional form made of steel. The steel form 10 with smooth surface has the advantages of easily detachable after concrete dries, the smoothly finished concrete surface can be obtained without the necessity of successive step of polishing the concrete surface to follow. On the other hand, the price of the steel form 10 is disadvantageously too expensive.

In order to overcome the disadvantages inherent to the conventional lumber form, the inventor of the present invention disclosed by the title of "Manufacturing Method for Construction Form Material Composed of Hemp Fiber" (Application No. 83104062) which was honored by a patent from Patent Bureau of Taiwan. From then on, he has continued to do his best for research and experiment trying to discover more perfect and innovative product in this field and fortunately succeeded in providing non oil coated construction form of the present invention which is now to be disclosed hereinafter.

SUMMARY OF THE INVENTION

Accordingly, it is an object of the present invention to provide non oil coated construction form having sufficient strength and flat smooth surface to obtain smooth and fine corresponding surface of concrete body.

It is another object of the present invention to provide non oil coated construction form without any seams or clearances causing waste of wet concrete by leaking therethrough.

It is still another object of the present invention to provide non oil coated construction form which can withstand impinging of concrete so as to lengthen its life time and save its depreciation cost.

It is one more object of the present invention to provide non oil coated construction form to prevent scarring of the finished surface of the concrete body by sticking of sand particles owing to coating oil on the form plates.

It is an additional yet important object of the present invention to provide non oil coated construction form which is made of inexpensive materials other than lumber or steel to save production cost and natural resources.

To achieve these and other objects, gist of the present invention is directed to provide a non oil coated construction form made of braided hemp fiber impregnated in phenolic resin and a hardener, and after drying, cooling, cutting and thermocompressing to be formed in a laminated phenolic compound resin of flat plate shaped form material. As it is well known that braided hemp fiber may be used to made into a bag for packing heavy grains such as rice, wheat, barley etc. So the braided hemp fiber plate without corrugation manufactured according to the above mentioned patented method (App. No. 83104062 Taiwan) has an intensified strength and a long life. The surface of the plate made in this way is then polished flat and smooth without remaining seams, grains, streaks, burrs or clearances and the like thereby achieving the objects mentioned above.

BRIEF DESCRIPTION OF THE DRAWINGS

The accompanying drawings, which are included to provide a fuller understanding of the invention and incorporated in and constitute a part of this specification, illustrate embodiment of the invention and together with the description serve to explain the principles of the invention, wherein.

DETAILED DESCRIPTION OF THE PREFERRED EMBODIMENT

Figure 1A:
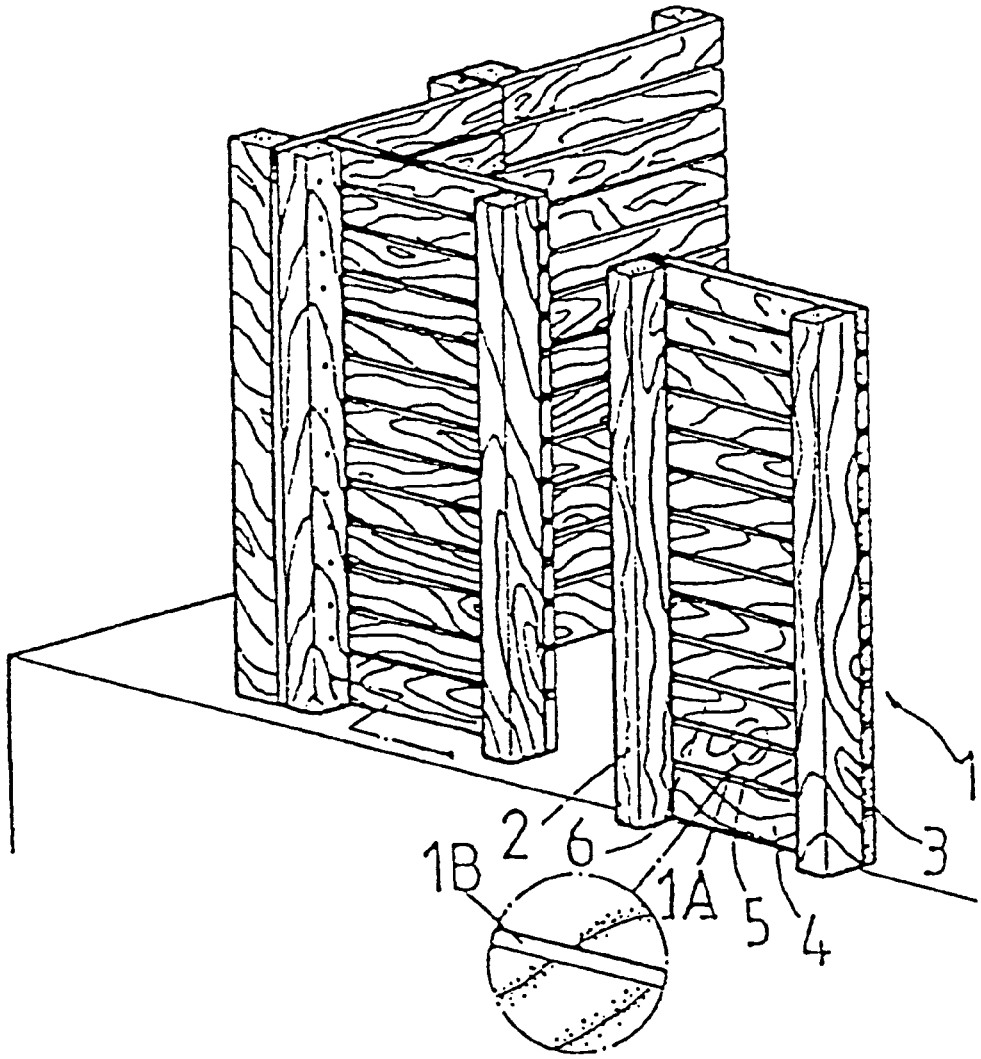
FIG 1A ( PRIOR ART )
FIG. 1A is a schematic drawing of a conventional lumber construction form.
Figure 1B:
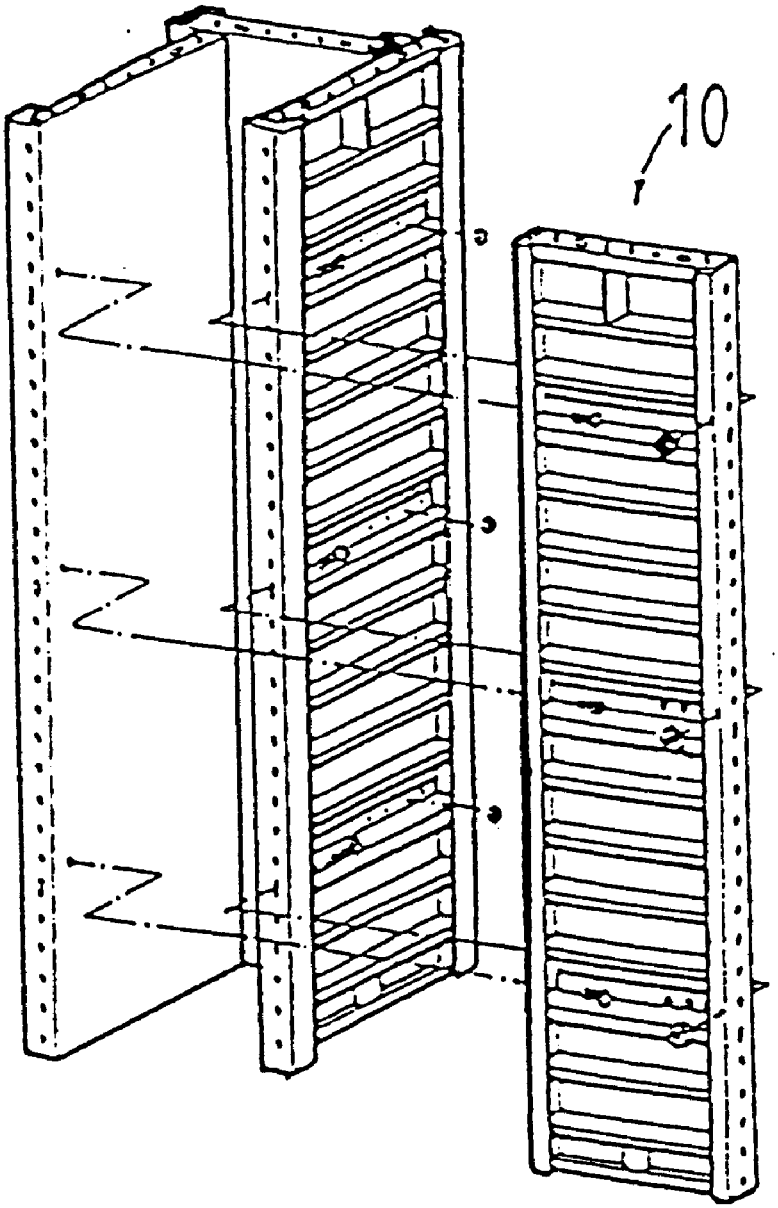
FIG 1B ( PRIOR ART )
FIG. 1B is a schematic drawing of another conventional steel construction form.

FIGS. 1A and 1B relate to drawings of conventionally employed construction forms, their aspects, advantages and disadvantages have been discussed above and will not be repeated.

Figure 2:
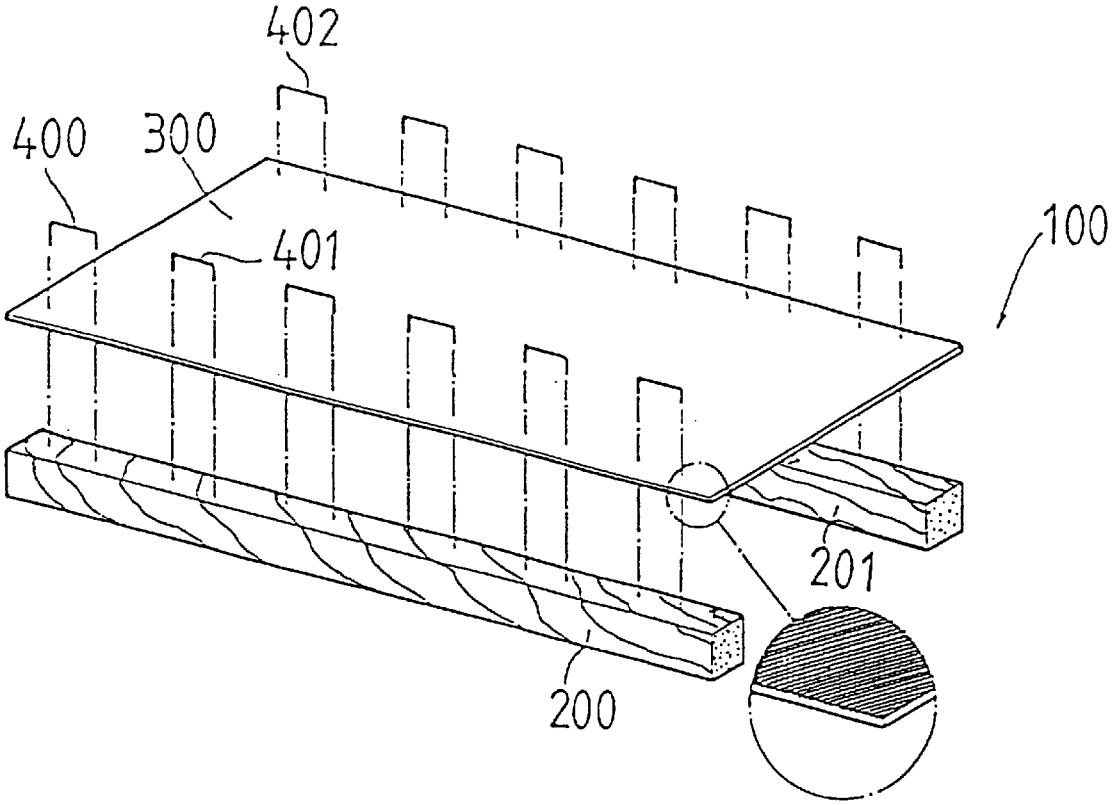
FIG. 2 is a three dimensional exploded drawing of the non oil coated construction form of the present invention.

FIG. 2 is a three dimensional exploded drawing of the present invention, it is understood from the drawing that the construction form 100 of the present invention is composed of a pair of struts 200, 201 and a flat plate 300 with its rear surface fixed successively with a plurality of nailed joints 400, 401, 402 . . . to the struts 200, 201 . . . . The struts 200, 201 are formed into a rectangular column shape both fixed to one surface of the plate 300. The plate 300 is made of braided hemp fiber impregnated in phenolic resin and hardened by a hardener, and after drying, cooling, cutting and thermocompressing to be formed in a laminated phenolic compound resin material whose detailed manufacturing method were described in the above mentioned patented case (App. No. 83104062 Taiwan). The material is formed into a flat plate without corrugation. From an enlarged view of the surface of the plate 300, it is observed that there are slightly projected mesh holes filled with hardener so that there are no clearances or streaks allowed to exist thereon. After performing the step of slight polishing, a plate 300 of intensified mechanical strength with flat, fine and smooth surface can be obtained. It should be pointed out that the plurality of nailed joints 400, 401, 402 . . . are so small in size that protrusion of them from the surface of plate 300 does not affect the flatness and smoothness of the surface of plate 300.

Figure 3:
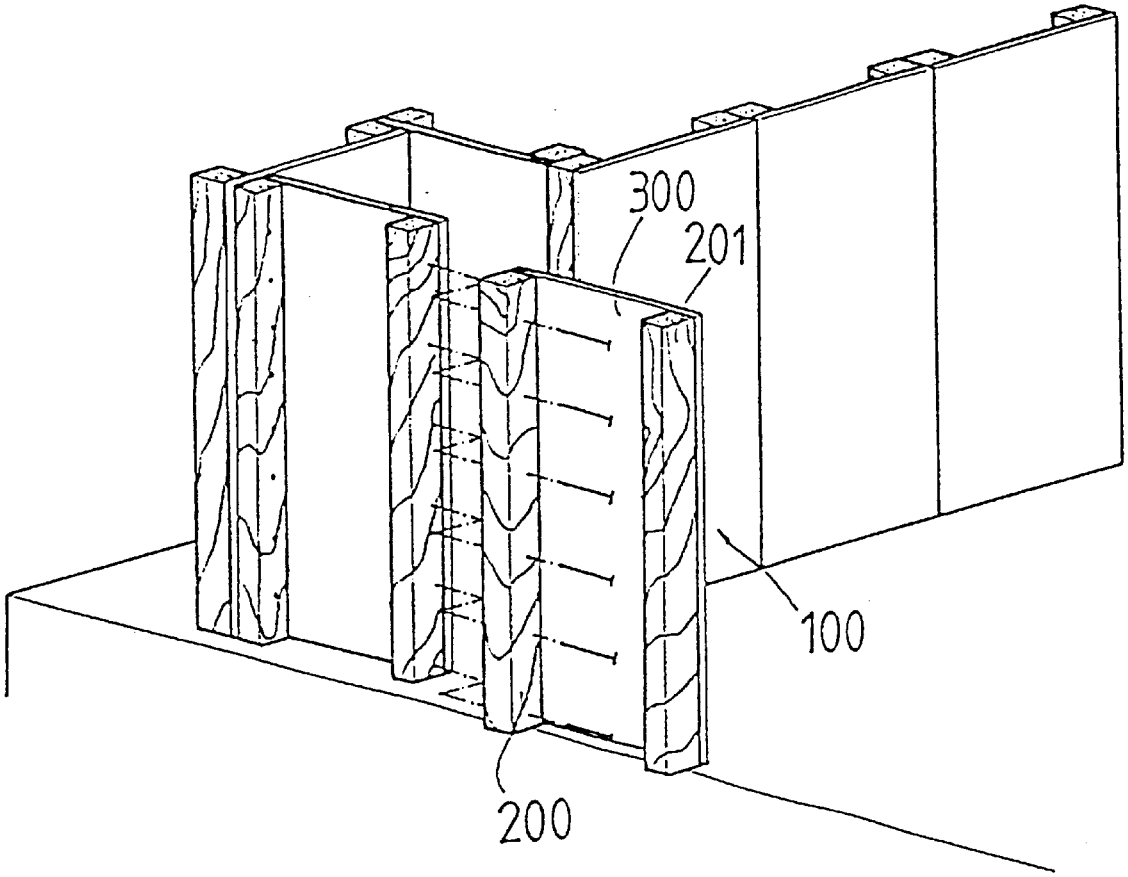
FIG. 3 is a schematic drawing of the non oil coated construction form in an embodiment of the present invention.

As shown in FIG. 3, when form 1 of the present invention is to be assembled, the respective plate 300 is fixed to struts 200, 201 at its both sides with the nailed joints 400, 401, 402 . . . . Then by successively connecting the plates 300 along the designated route with the struts facing outwardly, a predetermined closed structural configuration surrounded by the form 1 ready for deposition of wet concrete is therefore obtained.

The braided hemp fiber made, non oil coating and having sufficient strength with flat, smooth, seamless, and no clearance construction form of the present invention is created and applied as such.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

What is claimed is:

1. Non oil coated construction form composed of a pair of struts and a flat plate with its rear surface fixed successively with a plurality of nailed joints to said struts, said plate being made of braided hemp fiber impregnated in phenolic resin and hardened by a hardener, and after drying, cooling, cutting and thermocompressing to be formed into a laminated phenolic compound resin material with intensified mechanical strength and a flat, smooth surface.

* * * * *